US005135136A

United States Patent [19]

Moone

[11] Patent Number: 5,135,136

[45] Date of Patent: Aug. 4, 1992

[54] DEVICE FOR USE IN VARYING THE EFFECTIVE CROSS-SECTIONAL AREA OF AN OUTLET OPENING OF A DISPENSING UNIT

[75] Inventor: Ronald Moone, Woodley, England

[73] Assignee: A. J. Antunes & Co., Addison, Ill.

[21] Appl. No.: 699,883

[22] Filed: May 14, 1991

[30] Foreign Application Priority Data

May 17, 1990 [GB] United Kingdom ..... 9011071

[51] Int. Cl.[5] ..... A47F 1/04

[52] U.S. Cl. ..... 221/304; 221/241

[58] Field of Search ..... 221/304, 279, 222, 223, 221/247, 248, 251, 297, 241

[56] References Cited

U.S. PATENT DOCUMENTS

| | | | |
|---|---|---|---|
| 2,063,576 | 12/1936 | Bares | 312/43 |
| 2,315,827 | 4/1943 | Tansley | 221/304 |
| 3,163,323 | 12/1964 | Behrens | 221/4 |
| 4,804,108 | 2/1989 | Ficken | 221/304 |
| 4,854,479 | 8/1989 | Callahan et al. | 221/304 |

FOREIGN PATENT DOCUMENTS

| | | |
|---|---|---|
| 1261646 | 2/1968 | Fed. Rep. of Germany . |
| 3239315 | 4/1984 | Fed. Rep. of Germany . |

*Primary Examiner*—Robert P. Olszewski
*Assistant Examiner*—Kenneth Noland
*Attorney, Agent, or Firm*—Leydig, Voit & Mayer

[57] ABSTRACT

A device for use in varying the effective cross-sectional area of an outlet opening of a dispensing unit for nested containers, e.g. paper cups, comprises at least two shutter members, pivotally mounted on equispaced pivots of a support means at the outlet end portion of the unit to define the outlet opening. The members are mounted for movement to vary the size of the opening; an adjustment device is mounted for rotation in operative connection with the shutter members whereby to move the members to adjust the size of the outlet opening. Adjustment of the area of the opening is readily accomplished so that the unit can be adjusted to accommodate cups of different dimensions.

15 Claims, 7 Drawing Sheets

DEVICE FOR USE IN VARYING THE EFFECTIVE CROSS-SECTIONAL AREA OF AN OUTLET OPENING OF A DISPENSING UNIT

BACKGROUND OF THE INVENTION

1. Field of the Invention

This invention relates to a device for use in varying the effective cross-sectional area of an outlet opening of a dispensing unit for nested containers, for example a cup dispensing unit for use in conjunction with a drinks machine.

2. Description of the Prior Art

Previously, the outlets of adjustable cup dispensers have comprised sheets of metal folded to form a substantially circular outlet opening, such that the diameter of the opening can be varied by increasing or decreasing the size of the overlap, the sheet being held by a wing nut fastening arrangement or the like. However, there can be difficulty in gaining access to the fastening device, so that the diameter of the outlet opening is not readily adjustable when it needs to be changed.

Furthermore, there is a tendency for spillage of drinks onto the cup dispenser to get into this overlap, and for the drips of drink to crystallise within it, thus accentuating the difficulty of adjustment still further and making compliance with hygiene standards difficult.

One of the objects of the present invention is to provide an improved device for use in varying the effective cross-sectional area of the outlet opening of a dispensing unit.

SUMMARY OF THE INVENTION

According to a first aspect of the present invention there is provided a device suitable for use in varying the effective cross-sectional area of an outlet opening of a dispensing unit for nested containers comprising at least two shutter members supported at an outlet end portion of the unit to define the outlet opening, the members being mounted for movement whereby to vary the size of the opening; and adjustment means in operative connection with the shutter members whereby to move the members simultaneously to adjust the size of the outlet opening.

Preferably in a device in accordance with the invention there are at least three shutter members. Suitably the adjustment means are mounted for rotation in operative connection with the shutter members, and are adapted to effect adjustment of the shutter members by cam action.

In a preferred device in accordance with the present invention, the shutter members are pivotally mounted on equispaced pivots of a support means by which the shutter members are supported at the outlet end portion of a dispensing unit; and a peg is associated with each shutter member, each peg being slidingly received in an eccentric groove in the adjustment means whereby to effect said movement of the members.

Preferably, the shutter members have arms substantially perpendicular to the plane of the outlet opening, and adapted to project away from the adjustment means towards a body of the device. Suitably, the arms of the shutter members are inclined at 89° to the plane of the outlet opening outwardly away from a central axis of the device.

Preferably, the arms of the shutter members have a double bump on the side facing towards the central axis of the outlet opening of the device.

In a preferred device in accordance with the present invention, an attachment means is adapted to pass through each one of at least three elongated concentric slots on support means by which the shutter members are supported at the outlet end portion of the unit, to run freely within the slot upon rotation of the adjustment means, and to pass into the adjustment means, thus to mount the adjustment means on the support means.

Preferably, one of the attachment means comprises a toothed member movable between a position in which the teeth are in mating engagement with teeth on the support means adjacent one of the elongated concentric slots, whereby to lock the adjustment means against rotation relative to the support means, and a position such that the teeth are disengaged so that the adjustment means can be rotated.

There now follows a detailed description, to be read with reference to the accompanying drawings, of a cup dispensing unit comprising a device embodying the invention. It will be realised that this unit has been selected for description to illustrate the invention by way of example only.

DESCRIPTION OF THE PREFERRED EMBODIMENT

Figure 1:
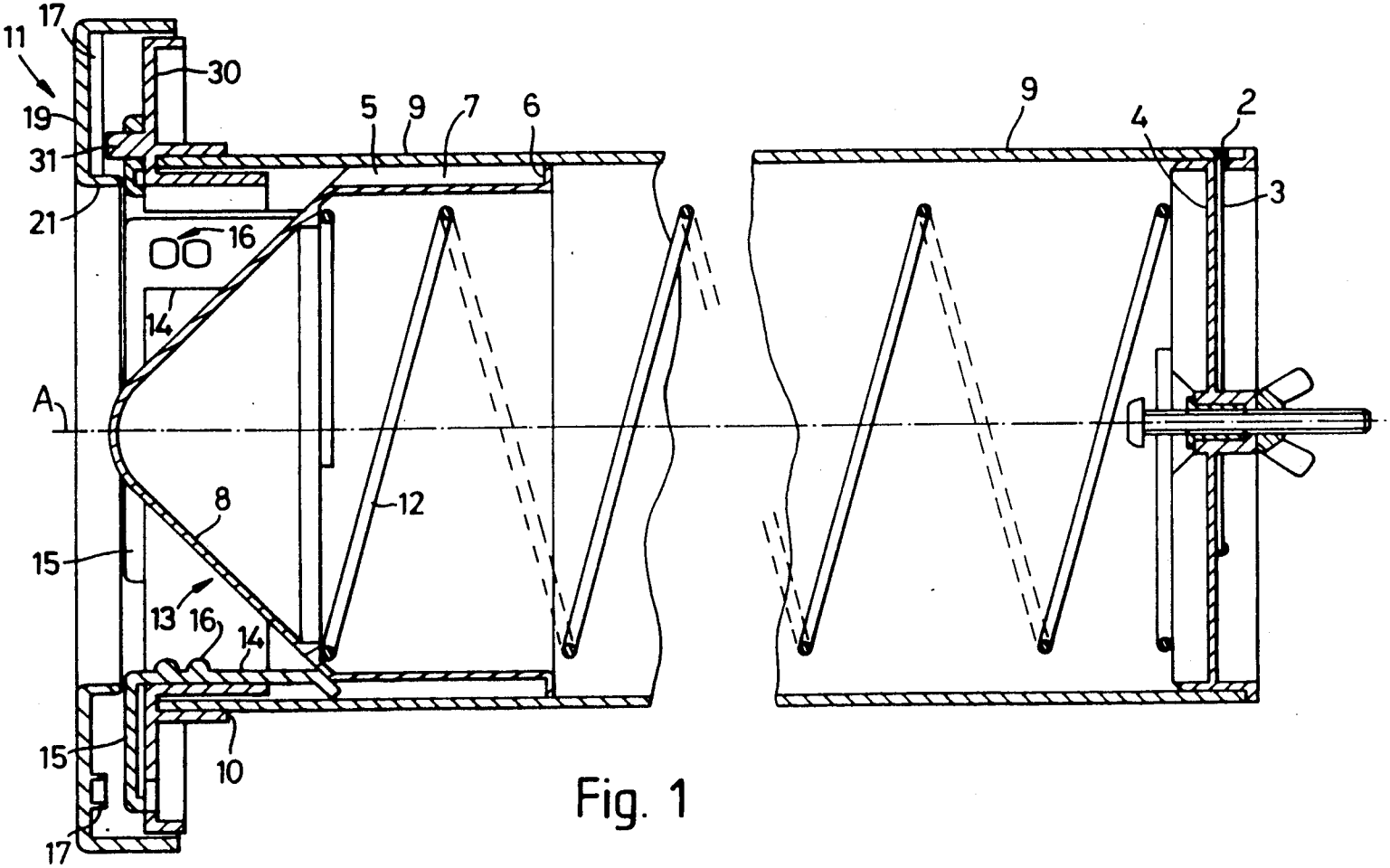
FIG. 1 is a side view, partly in section, of the cup dispensing unit.

Illustrated in FIG. 1 is a suitable dispensing unit 11 for nested containers of generally frusto-conical shape, e.g. a stack of plastic or paper cups. A generally low rate spring 12 runs the length of a tubular body 9 of the dispensing unit 11, and the stack of cups is mounted, face inwards, on a member 13 such that they are urged, bottom first, towards an outlet opening 21 of the unit 11, under the light force of the spring, so that as one cup is drawn out of the outlet opening 21 of the dispensing unit 11 by a user, a succeeding cup is presented in its place. When only the last few cups of the stack remain in the unit 11, the member 13 can then make contact with arms 14 and cause them to yield slightly so that the cups may no longer held firmly within the arms 14 which provides an indication to the operator that the unit needs refilling with containers.

The member 13 has the general form of a nose cone, having a conical forward end 8 which engages within the open end of the innermost cup in the stack, the axial extent of this engagement depending on the size (diameter) of the cups being employed at a given instant. The rearward end 7 of member 13 is cylindrical and hollow, having an out-turned flange 6 which is a sliding fit within the body 9. Three equispaced axially-extending ribs 5 are provided to stabilise the member 13 within the body 9, these ribs also being in slidable engagement with the interior of the body 9. The tubular body 9 is closed at its inner end by an end cap 4 held in position by a generally Y-shaped spring clip 3, the three points of which engage aligned apertures 2 in a peripheral wall of the end cap and the body 9. The end cap 4 is provided with central attachment means for mounting on a support if required.

Shutter members 15 are supported at an outlet end portion of the unit 11 to define the outlet opening 21. The arms 14 form part of the shutter members 15 and are substantially perpendicular to the plane of the outlet opening 21 and project into the body of the dispensing unit 11. These arms 14 guide the stack of cups past the inner radius of the shutter members 15. Suitably, the arms 14 are inclined at 89° to the plane of the outlet opening 21 outwardly away from a central axis A of the dispensing unit 11. At this angle, the cups are still held firmly within the arms 14, but this slight taper aids in retaining the cups in the unit 11 until one is drawn out of the dispensing unit 11.

The arms 14 have a double bump detail 16 moulded on the side of the arm 14 facing towards the central axis A of the dispensing unit 11. A cup lip (which in "paper" cups is formed of rolled paper) is retained between the two bumps until it is physically pulled out of the unit 11. In other dispensing units, the cups commonly are retained by a sharp-edged member, and the problem of the lip of the cup becoming unrolled can arise, even resulting in the edge of the cup becoming sharp enough to cut the lips of a person drinking from the cup. Retaining the lip of the cup within this double bump detail 16 overcomes such a problem.

Figure 2:
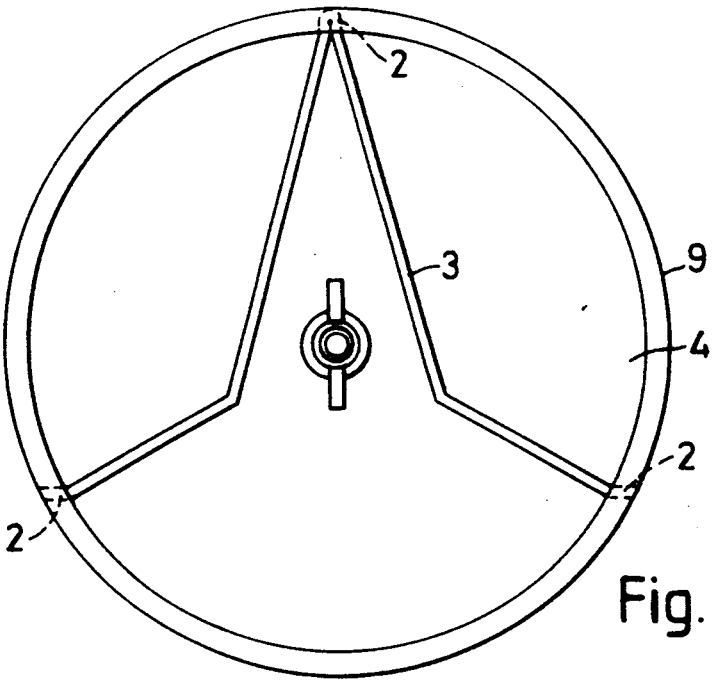
FIG. 2 is view from the right-hand side of FIG. 1.
Figure 3:
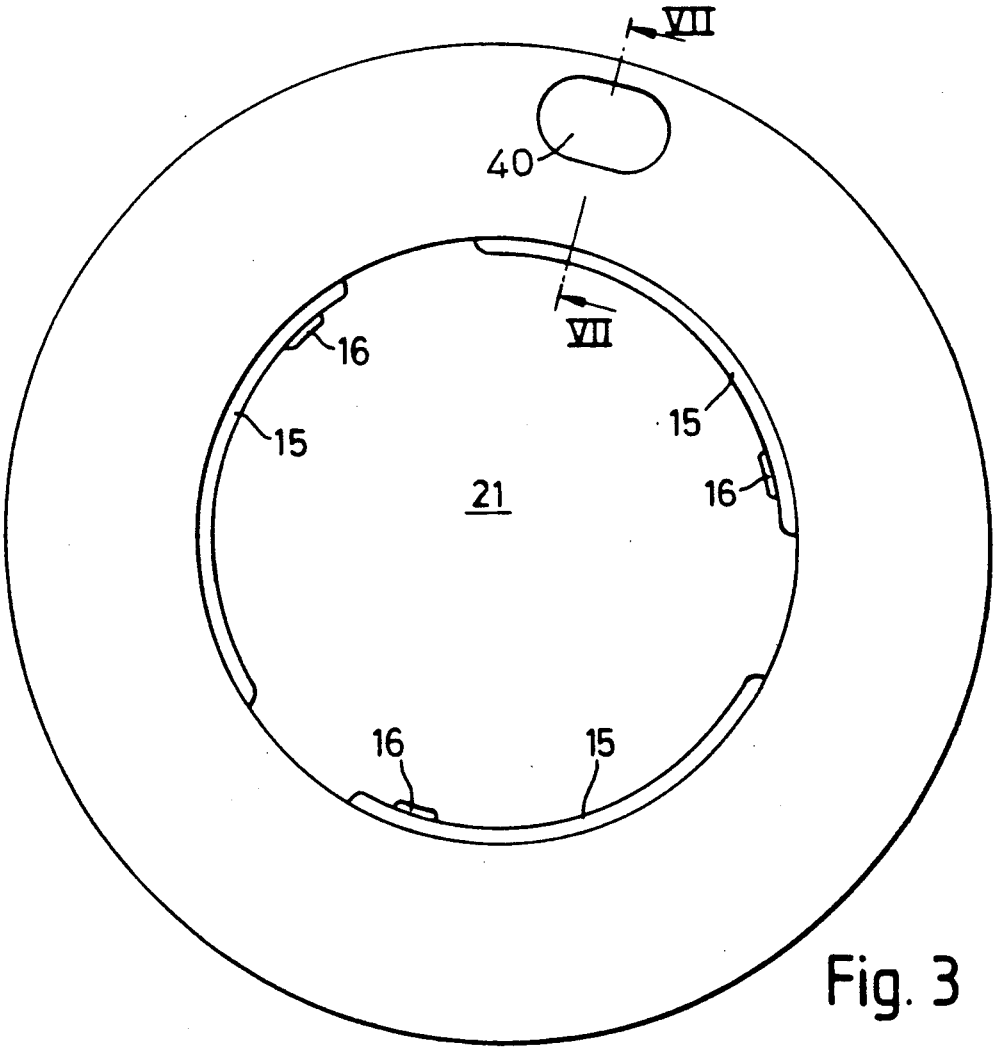
FIG. 3 is a view from the left-hand side of FIG. 1.
Figure 4:
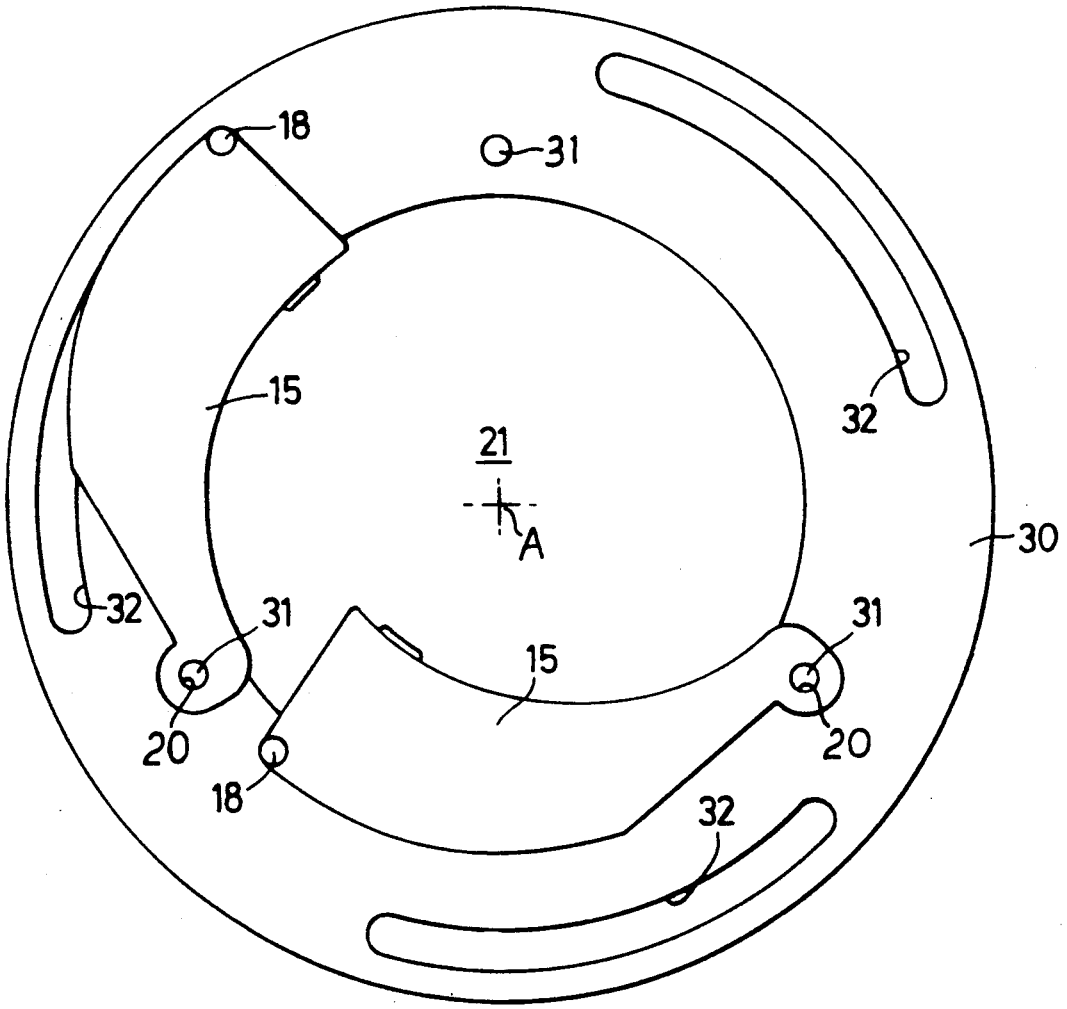
FIG. 4 is a view similar to that of FIG. 3 but with a cover ring removed.

With reference to FIG. 4, three generally planar shutter members 15 are mounted on support means or base ring 30 (see FIGS. 4 and 6) at the outlet end portion of the unit 11 to define the outlet opening 21. Only two of these shutter members 15 are shown in FIG. 2 for clarity, but all three are seen in FIG. 3. The shutter members 15 are of generally similar shape in plan. A radius on the inside edge facilitates the easy loading of the cups, where they are loaded as a stack into the unit 11 through the outlet opening 21. The support means 30 is secured, for example by adhesive, to one end of the body 9 which is received in an annular groove or recess 10 in the support means.

Figure 6:
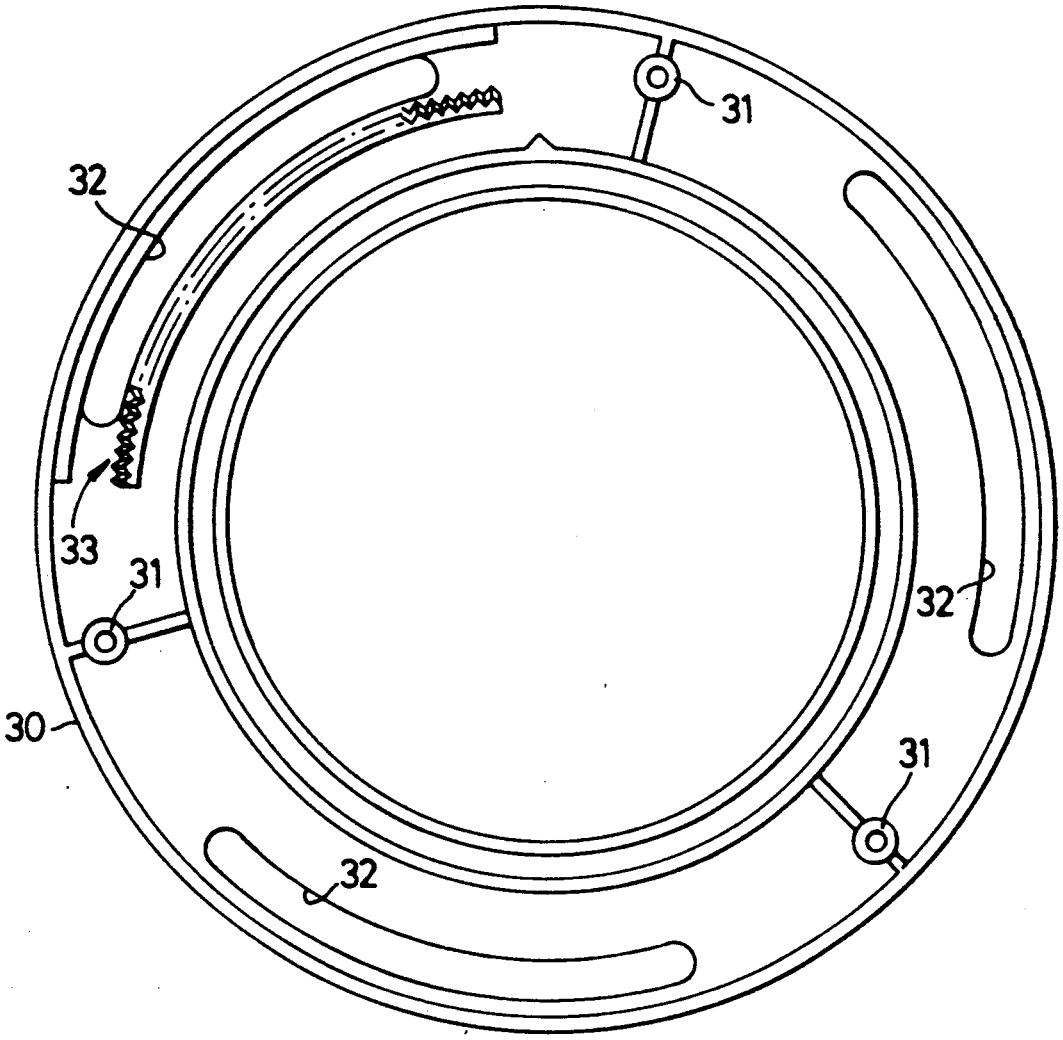
FIG. 6 is a view from the opposite side of FIG. 3 with certain components removed.

Each shutter member 15 has a hole 20 at one end which is mounted on a pivot 31 on the support means 30 (FIG. 6). Thus the shutter members 15 are pivotally mounted on equispaced pivots 31 on the support means 30 such that they can be moved to pivot inwardly and outwardly towards and away from the centre of the opening 21.

Figure 5:
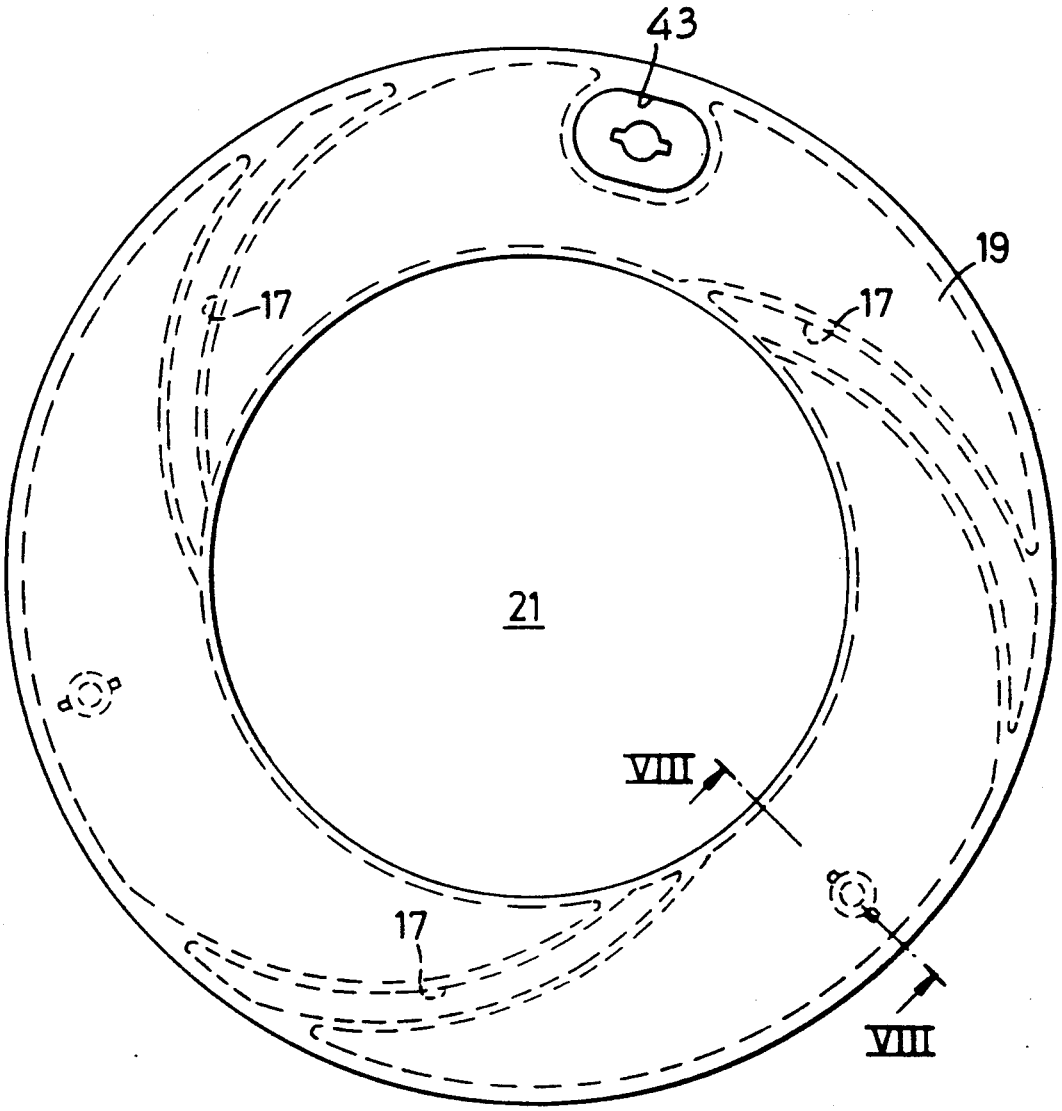
FIG. 5 is a plan view of the cover ring, showing hidden detail.
Figure 9:
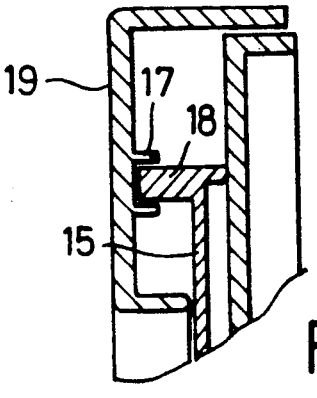
FIG. 9 is a fragmentary view of an alternative section at the left-hand end of FIG. 1.
Figure 10:
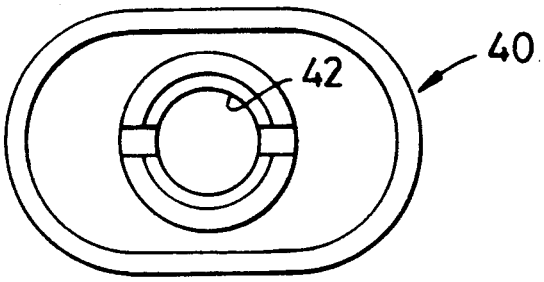
FIG. 10 is an underneath view of a component of FIG. 7.

In a corner of each shutter member 15 at the opposite end to the hole 20 is a peg 18. Each peg 18 is slidingly received in an associated eccentric groove 17 on the inner side of an outer cover ring forming an adjustment means 19 as seen in FIG. 9, the grooves being best seen in FIG. 5. As the adjustment means 19 is rotated, the path followed by each peg 18 pushes the associated shutter member 15 causing it to pivot into or out of the opening 21 about the pivot 31 dependent on the direction of rotation of the adjustment means.

Rotation of the adjustment means 19 by 60° adjusts the shutter members 15 over a desired range of movement to adjust the opening 21 between its maximum and minimum dimensions; the curvature of the eccentric grooves 17 ensures a smooth movement from maximum to minimum.

Therefore, the adjustment means 19 is mounted for rotation in operative connection with the shutter members 15 whereby to move the members 15 by cam action to adjust the size of the outlet opening 21.

Figure 8:
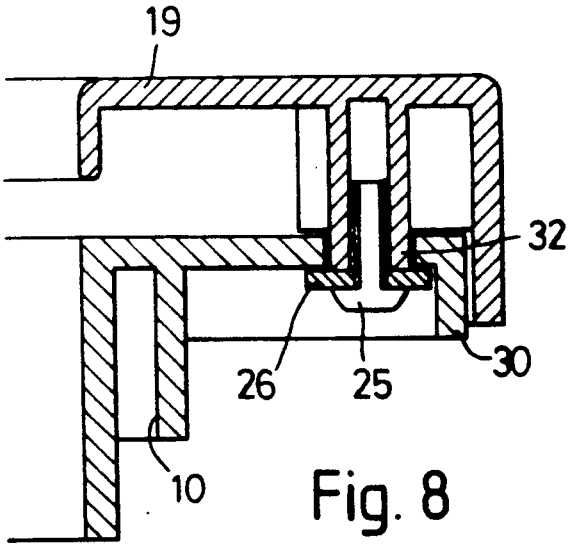
FIG. 8 is a section, to a larger scale, on the line VIII—VIII of FIG. 5.

Referring to FIGS. 4,6 and 8, the adjustment means 19 are mounted to the support means 30 by three attachment means adapted to pass through respective ones of three elongated concentric slots 32 on the support means 30, to run freely within the slot 32 upon rotation of the adjustment means 19, and to pass through the support means 30. Two of the attachment means are as shown in FIG. 8 and comprise a screw 25 passing through the support means 30 and into a hollow boss provided on the adjustment means 19, with a washer 26 on the screw 25 positioned to slide on the underside of the support means 30 for ease of movement of the attachment means within the slots 32. It will be appreciated that FIG. 4 shows the support means 30 with the adjustment means 19 removed, and FIG. 6 shows the underside of the support means.

Figure 7:
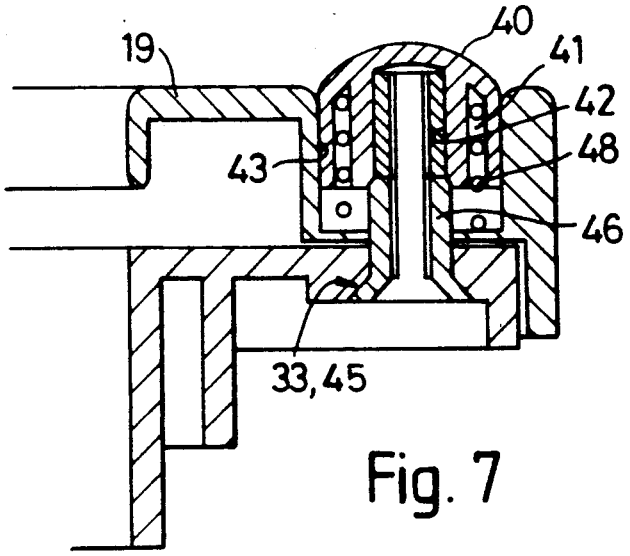
FIG. 7 is a section, to a larger scale, on the line VII—VII of FIG. 3.

Referring to FIG. 7, the third attachment means comprises a push button 40 which is housed in a button recess 43 in the adjustment means 19. A generally cylindrical stud 46, but having a pair of diametrically opposed keys 47 of rectangular section, of an inner toothed member or plate 44 (FIGS. 11 and 12) is received in a complementary opening 42 in a central boss of the button 40, the stud 46 projecting through the corresponding slot 32 and a complementary shaped opening in the base of the recess 43. A compression spring 48 is housed in a recess 41 around the boss and acts between the button 40 and the base of the button recess 43 to urge the button outwardly of the button recess 43 and hence to urge the toothed member 44 in a direction such that its teeth 45 are held in mesh with teeth 33 formed on the adjacent edge of the associated elongated slot 32, (see FIG. 4), whereby to lock the adjustment means 19 against rotation relative to the support means 30. The fact that the toothed member 44 is keyed in position relative to the support means 30 means that its teeth are always correctly presented for meshing with the teeth 33.

However, if the button 40 is pushed inwardly of the recess 43, against the spring action, the button 40 pushes the member 44 such that the teeth 45 thereof disengage the teeth 33 on the support means 30 and the adjustment means 19 then can be rotated. On release of the button 40, the spring urges the button 40 outwardly such that the initial, locked position is adopted once more, with the teeth 33, 45 in mesh but with the adjustment means 19, and hence shutter members 15 in the adjusted position.

Figure 11:
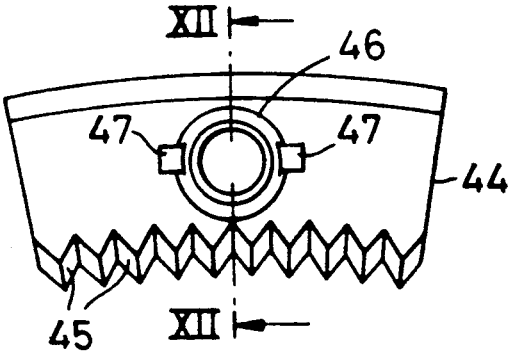
FIG. 11 is a plan view of a toothed component of FIG. 7.
Figure 12:
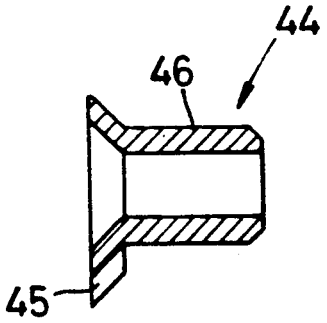
FIG. 12 is a section on the line XII—XII of FIG. 11.

Referring to FIG. 11, the teeth 45 are equispaced at 2° intervals, the pitch of the teeth 45 determining the adjustment increments of the adjustment means 19 that can be made. The illustrated dispensing unit 11 is adapted to hold as a minimum size a 4 fl. oz. (113.6 $cm^3$) container, e.g. a vending cup, and as a maximum size a 32 fl. oz. (909.12 $cm^3$) container, e.g. a popcorn container, with seven or eight sizes in between. In fact, some 30 different settings are possible with the illustrated arrangement. Obviously, at certain positions of rotation of the adjustment means 19 the points of the teeth 33,45 meet, such that a small adjustment is needed to make the two sets of teeth mesh to lock the members 15 in their adjusted position. However, in view of the 2° pitch of the teeth, this adjustment is extremely small and does not have any material and adverse effect on the selected setting and thus on the ability of the unit to be able to dispense containers of the required size. In FIG. 4, one of the two shown shutter members 15 is set at maximum diameter to accept a 32 fl. oz. cup (as are all the shutter members in FIG. 1), and the other is set at minimum diameter to accept a 4 fl. oz. container, to illustrate these extreme settings..

The illustrative unit therefore provides an adjusting mechanism which allows the dispensing unit 11 to be adjusted to accommodate frusto-conical containers of different sizes, so that a particular dispenser can be fitted with a stack of containers of a selected size according to need at one instant, and readily adjusted to accommodate a different size of container at another instant. The benefits of adjustability are realised without the requirement for removal of the outlet end portion of the unit, and adjustment can be easily made by a user. If desired a visible scale may be provided to facilitate adjustment to a selected cup dimension, according to the position of the adjustment means relative to the support means. The scale may be carried on the outer faces of the shutter members 15.

All of the components of the unit, save for the screws, are moulded from a synthetic plastics material which is readily cleaned when necessary and since the face of the outer cover ring or adjustment means 19 is plain, except for the button recess, and the outer faces of the shutter members 15 are plain, any spillage from an adjacent liquid dispenser to which a dispensed container may be offered is easily wiped and in any event cannot easily find its way into the operating mechanism to interfere with the operation thereof.

Dispensing units embodying the present invention find ready application in fast food outlets, for example, in which very often many drink vending stations are employed and each of which may have to be adjusted from time to time as regards the size of container to be dispensed.

I claim:

1. A device for varying the effective cross-sectional area of an outlet opening of a dispensing unit for nested containers comprising at least two shutter members supported on support means at an outlet end portion of said unit to define said outlet opening, said shutter members being mounted for movement whereby to vary the size of the opening, and adjustment means mounted for rotation in operative connection with the shutter members whereby to move the members simultaneously to adjust the size of the outlet opening, said adjustment means being mounted on said support means by a plurality of attachment means adapted to pass through respective ones of a similar number of elongated concentric slots in said support means by which said shutter members are supported at said outlet end portion of said unit, to run freely within the slots upon rotation of said adjustment means, and to pass into said adjustment means thus to mount said adjustment means on said support means, one of the attachment means comprising a toothed member movable between a position in which the teeth are in mesh with teeth on said support means adjacent one of said elongated concentric slots, whereby to lock the adjustment means against rotation relative to said support means, and a position such that said teeth are disengaged so that said adjustment means can be rotated.

2. A device according to claim 1 comprising at least three shutter members.

3. A device according to claim 1, wherein the adjustment means is adapted to effect adjustment of the shutter members by cam action.

4. A device according to claim 1, wherein the shutter members are pivotally mounted on equispaced pivots of said support means by which the shutter members are supported at the outlet end portion of said dispensing unit.

5. A device according to claim 1, wherein a peg is associated with each shutter member, each peg being slidingly received in an eccentric groove in the adjustment means whereby to effect said movement of the members.

6. A device according to claim 1, wherein the toothed member is movable out of mesh with the teeth on the support means by a push button resiliently mounted on the adjustment means.

7. A device according to claim 1, wherein the shutter members have arms substantially perpendicular to the plane of the outlet opening and adapted to project away from the adjustment means towards a body of the device.

8. A device according to claim 7, wherein the arms of the shutter members are inclined at 89° to the plane of the outlet opening, outwardly away from a central axis of the device.

9. A device according to claim 8, wherein each arm has a double bump on the side facing into a central axis of the device.

10. A device for varying the effective cross-sectional area of an outlet opening of a dispensing unit for nested containers comprising at least two shutter members supported on support means at an outlet end portion of the unit to define the outlet opening, the shutter members being mounted for movement whereby to vary the size of the opening, and adjustment means mounted for rotation in operative connection with the shutter members whereby to move the members simultaneously to adjust the size of the outlet opening, said adjustment means being mounted on said support means by attachment means adapted to pass through slot means in said support means by which the shutter members are supported at the outlet end portion of the unit, to run freely within the slot means upon rotation of the adjustment means, and to pass into the adjustment means thus to mount the adjustment means on the support means.

11. A device according to claim 10, wherein a plurality of attachment means is provided, and wherein one of the attachment means comprises a toothed member movable between a position in which the teeth are in mesh with teeth on the support means, whereby to lock the adjustment means against rotation relative to the support means, and a position such that the teeth are disengaged so that the adjustment means can be rotated.

12. A device according to claim 11, wherein the toothed member is movable out of mesh with the teeth on the support means by a push button resiliently mounted on the adjustment means.

13. A device according to claim 10, wherein the shutter members have arms substantially perpendicular to the plane of the outlet opening and adapted to project away from the adjustment means towards a body of the device.

14. A device according to claim 13, wherein the arms of the shutter members are inclined at 89° to the plane of the outlet opening, outwardly away from a central axis of the device.

15. A device according to of claim 14, wherein each arm has a double bump on the side facing into a central axis of the device.

* * * * *